US005218336A

United States Patent [19]

Murakami

[11] Patent Number: 5,218,336

[45] Date of Patent: Jun. 8, 1993

[54] RESISTOR DEVICE FOR BLOWER MOTOR

[75] Inventor: Iwao Murakami, Toro, Japan

[73] Assignee: Pacific Engineering Co., Ltd., Ogaki, Japan

[21] Appl. No.: 795,430

[22] Filed: Nov. 20, 1991

[30] Foreign Application Priority Data

Nov. 26, 1990 [JP] Japan ..... 2-124550[U]
Mar. 30, 1991 [JP] Japan ..... 3-44554[U]

[51] Int. Cl.[5] ..... H01C 1/14

[52] U.S. Cl. ..... 338/328; 338/22 R; 338/260

[58] Field of Search ..... 338/328, 220, 235, 260, 338/254, 255, 239, 295, 22 R, 225 D, 319, 320, 25

[56] References Cited

U.S. PATENT DOCUMENTS 3,737,622 6/1973 Hallgreen ..... 338/25
4,408,244 10/1983 Weible ..... 338/220
4,935,717 6/1990 Osawa et al. ..... 338/256 X
5,000,662 3/1991 Yamamoto et al. ..... 338/308 X

FOREIGN PATENT DOCUMENTS 0237228 9/1987 European Pat. Off. .
0363191 4/1990 European Pat. Off. .
2392521 12/1978 France .
1604111 2/1981 United Kingdom .

*Primary Examiner*—Marvin M. Lateef
*Attorney, Agent, or Firm*—David G. Conlin; George W. Neuner

[57] ABSTRACT

A resistor device for blower motor contains a plurality of PTC element plates having both side surfaces and disposed side by side substantially in a same plane. Each PTC element has an electrode formed on each of said both side surfaces thereof. The device has a plurality of terminal plates sandwiching the PTC element plates from the both side surfaces thereof.

16 Claims, 4 Drawing Sheets

RESISTOR DEVICE FOR BLOWER MOTOR

BACKGROUND OF THE INVENTION

1. Field of the Invention

The present invention relates to a resistor device for controlling rotational speed of a blower motor used for an air conditioning system, for instance, installed in an automobile.

2. Description of the Related Art

The resistor device mentioned above is disposed around an outlet of an blower of an air conditioning system of an automobile so that the resistor device is cooled by the wind from the blower.

The resistor device of the kind is disclosed in Japanese Patent Publications (KOKOKU) No.57-45041 and No.57-32482 in which a semiconductor element of positive temperature coefficient (referred to as PTC element hereinafter) is used as the resistor element of the device. The PTC element has such a characteristic, as widely known, that the resistance thereof rises abruptly and greatly when the am temperature exceeds a predetermined value (Curie temperature). As a result, when the PTC element is not appropriately cooled when the current is applied thereto or when an excessive current over an allowable extent is applied to the motor, the temperature of the PTC element is raised gradually first and when the temperature reaches Curie temperature, the resistance of the element increases suddenly very large so that the current is controlled and the temperature is maintained below the Curie temperature. Accordingly, the PTC element is very useful for proper operation of the motor and avoiding fire of the automobile.

However, according to the above mentioned Japanese patent publications (57-45041 and 57-32482) aiming at the safety structure for the motor and vehicle, the resistor device is arranged in such a manner that a plurality of ring-shaped PTC element plates and a plurality of terminal plates having a center hole are disposed alternately and combined together by bolt inserted through the center holes of the plates and secured together by a nut screwed on the bolt. In this structure, it becomes necessary to dispose an insulation spacer between the bolt and the terminal plates to avoid contact and the short circuit between the bolt and the terminal plates. As a result, the structure becomes complicated and proper adjustment of the torque for fastening the nut is necessitated, which makes the assembling work troublesome and the cost of the device becomes high.

SUMMARY OF THE INVENTION

The present invention was made considering the above mentioned problems of the related art.

It is therefore an object of the present invention to provide a resistor device for blower motor wherein the number of parts is reduced and the resistance against the wind from the blower is decreased, which makes it possible to simplify the structure, especially reduce the thickness of the device and raise the reliability of the device.

Another object of the present invention is to provide a resistor device for blower motor wherein the productivity of the device is raised and the treatment and maintenance of the device can be conveniently conducted.

Also, it is required that the structure of the resistor device be compact so as to reduce the airflow loss of the blower as possible for a given capacity.

Still another object of the present invention is to provide a resistor device for blower motor which satisfies the requirement mentioned above.

The above mentioned objects can be achieved by a resistor device for blower motor comprising:

a plurality of PTC element plates having both side surfaces and disposed side by side substantially in a same plane, each element plate having an electrode formed on each of the both side surfaces thereof; and a plurality of terminal plates sandwiching the PTC element plates from the both side surfaces thereof.

In accordance with a preferred embodiment of the present invention, the plurality of terminal plates include a plate comprising an electrode disposed spanning between a plurality of PTC element plates.

In accordance with another preferred embodiment of the present invention, the plurality of PTC element plates are connected sequentially in series through the terminal plates disposed in both side surfaces of the PTC element plates.

In accordance with a further preferred embodiment of the present invention, the terminal plate has one or more electrode terminal portion projecting therefrom.

In accordance with a still further preferred embodiment of the present invention, the PTC element plates sandwiched by the terminal plates are attached to a base holder in such a way that the projecting terminal portions of the terminal plates are inserted into throughholes formed in the base holder corresponding to the terminal portions.

In accordance with a still further preferred embodiment of the present invention, the PTC element plates and terminal plates are held and clamped by an elastic clip unit.

In accordance with a still further preferred embodiment of the present invention, the PTC element plates and terminal plates are held and clamped by a rivet at a corner thereof.

In accordance with a still further preferred embodiment of the present invention, the PTC element plates and terminal plates are held and clamped by a rectangular frame unit.

In accordance with the arrangement of the present invention mentioned above, a plurality of PTC elements can be held without using screws or an insulation bush by such a way that the PTC elements are disposed side by side in one plane and sandwiched by a pair of terminal plates, which makes it possible to realize a resistor device having a regular thickness irrespective of the number of PTC elements.

Also, in accordance with the resistor device of the present invention, a pair of terminal plates and the PTC element are combined together in such a way that an end electrode of one of the terminal plate is connected in series to the other end electrode of the other terminal plate through the other electrodes of the terminal plates and the PTC elements sandwiched between the terminal plates. With such an arrangement, the number of resistance values obtained from the resistor device becomes the total combination number of any two electrode terminals.

Therefore, it is an advantage that a lot of different resistance values can be easily obtained from the resistor device.

Another advantage of the present invention is that the structure becomes compact as a whole, which reduces the airflow loss of the blower and raises the current capacity of the blower motor according as the cooling effect is increased.

Further advantages are that the base holder structure can also be simplified, that the number of parts can be reduced, and that the device can be easily and reliably assembled, as a result of which the industrial applicability of the device can be raised.

It is to be noted that the term "terminal plate" used in the present invention includes not only the plate which itself is made from a conductive member such as metal constituting an electrode itself but also a structure comprising an electric insulation plate having metal electrodes formed thereon as well.

Further objects and advantages of the present invention will be apparent from the following description of the preferred embodiments of the invention as illustrated in the accompanying drawings.

DESCRIPTION OF THE PREFERRED EMBODIMENTS

Figure 1:
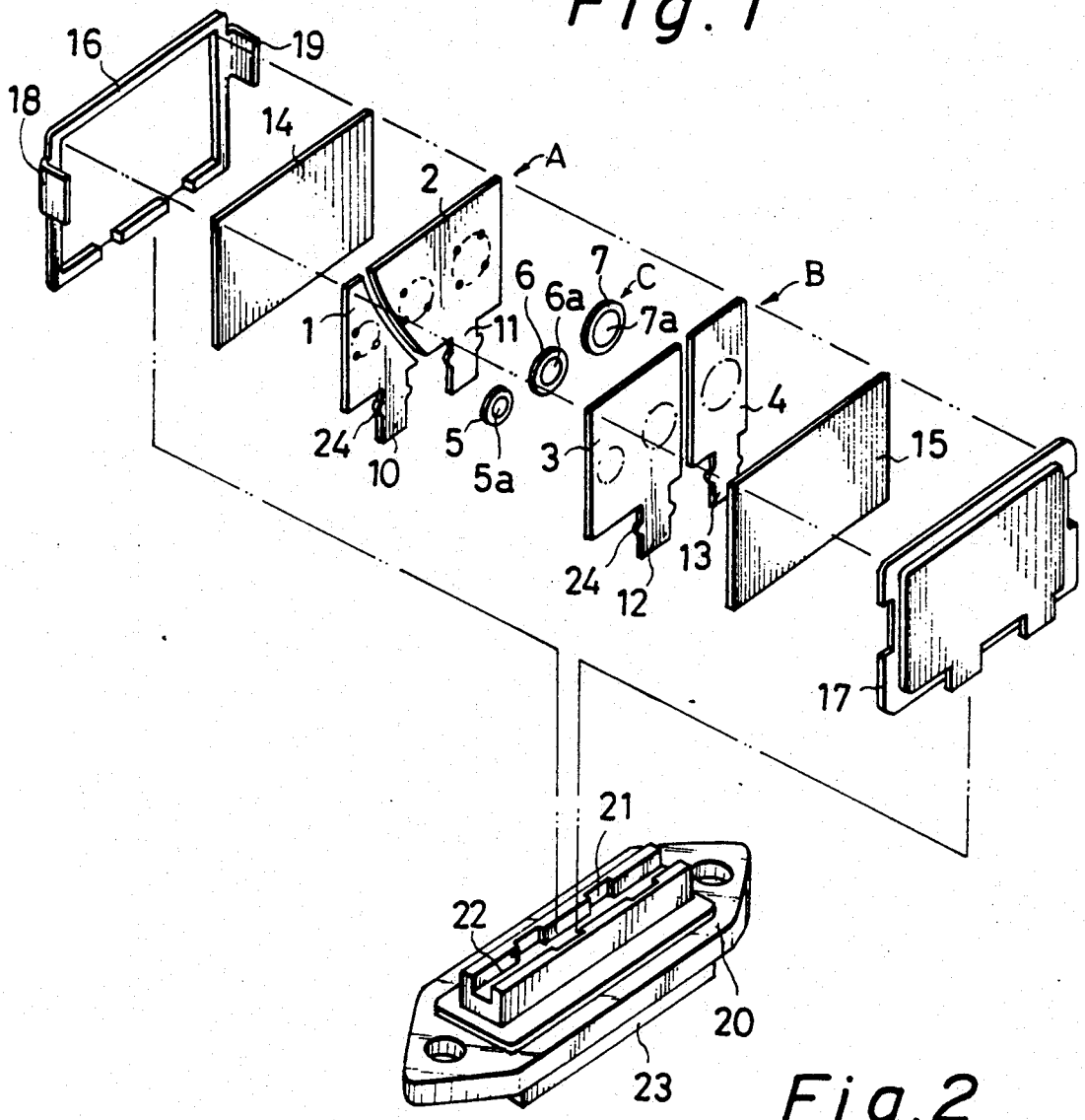
FIG. 1 is an exploded view of an embodiment of the resistor device in accordance with the present invention.

FIG. 1 illustrates an embodiment of the present invention in an exploded view. A PTC element group C comprises a plurality of PTC elements 5, 6 and 7, each element having a desired resistance value and current capacity depending on the requirement for use. The PTC elements have a regular thickness, respectively. Also, on each side surface of the PTC elements 5, 6 and 7 is formed an ohmic electrode *5a*, *6a*, *7a*, made from silver paste, for instance.

The PTC element is made from a ceramic member composed of $BaTiO_3$ or compound comprising $BaTiO_3$ or the component elements of the compound or the compound of the same group or series of $BaTiO_3$ or other ceramic or plastic members.

The "PTC element" hereinafter refers to the PTC plate having the electrodes formed on both sides thereof.

The PTC elements 5, 6 and 7 are disposed side by side in one plane. A terminal plate group A comprising two terminal plates 1 and 2 is disposed on one side of the PTC elements 5, 6 and 7. Also, another terminal plate group B comprising two terminal plates 3 and 4 is disposed on the other side of the PTC elements 5, 6 and 7. Each of the terminal plates 1 to 4 has a terminal 10, 11, 12, 13 formed at the lower edge projecting downward therefrom. The PTC element 5 is sandwiched by the terminal plates 1 and 3. The PTC element 6 is sandwiched by the terminal plates 2 and 3. And the PTC element 7 is sandwiched by the terminal plates 2 and 4.

Figure 2:
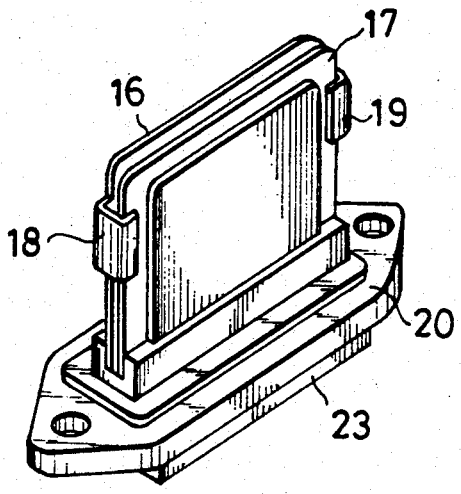
FIG. 2 is a perspective view of an assembles state of the resistor device of FIG. 1.

An electric insulation film 14 is disposed in the outside of the terminal plate group A. Similarly, an insulation film 15 is disposed in the outside of the terminal plate group B. The vertically layered structure of the PTC elements, terminal plates and insulation films is sandwiched by covers 16 and 17 which are made from aluminum, for instance, which is heat radiative. The covers 16 and 17 are combined and secured together by ears 18 and 19 which clamp the covers from outside thereof, as illustrated in FIG. 2, so that the PTC elements are held in a state being pressed by the terminal plates from both sides thereof.

An elastic clip means may be used to clamp the covers together instead of the ears 18 and 19.

The combined structure constituted from the PTC elements, terminal plates and insulation films sandwiched between the covers 16 and 17 is installed in a base holder 20 in such a way that each of the projecting terminals 10 to 13 of the terminal plates 1 to 4 is inserted into a through-hole 21 which is formed in a guide groove 22 of the base holder 20 at a position corresponding to each terminal.

The base holder 20 is made from synthetic resin which is heat resistant and electric insulating. The base holder 20 has the guide groove 22 formed along the center line thereof, as illustrated in FIG. 1. Through-holes 21 are formed in the groove 22 corresponding to the terminals 10 to 13 of the terminal plates 1 to 4, respectively. A connector housing 23 is formed in the lower side of the base holder 20 surrounding the through-holes 21 as a whole.

Each of the terminals 10 to 13 has a small projection 24 for engagement formed on each of lateral edges thereof so as to intrude into the inner surface of the through-hole wall to prevent each terminal from being slipped out from the through-hole.

As mentioned above, the PTC elements 5, 6 and 7 are disposed side by side in a same plane and interposed between a pair of terminal plate groups A and B which are sandwiched between the covers 16 and 17 through the insulation films 14 and 15 disposed in the outside of each terminal group. In this state, the covers 16 and 17 are combined and secured together by the ears 18 and 19 which are folded to clamp the covers together, as illustrated in FIG. 2. The sandwiched structure of the PTC elements covered by the covers 16 and 17 is attached to the base holder 20 in such a way that the terminals of the terminal plates are inserted into the through-holes 21 of the base holder 20 whereby the small projections 24 of each terminal engage and intrude into the inner wall of the through-hole so that the terminal is prevented from slipping out from the through-hole. Thus, the sandwiched structure is reliably assembled with the base holder.

In accordance with the embodiment of the present invention mentioned above, six different resistance values can be obtained from the combination of any two of four terminals 10 to 13.

The above mentioned embodiment refers to the arrangement wherein three PTC elements 5, 6 and 7 are sandwiched between two terminal plate groups A and B. However, the number of the PTC elements is not limited to three. Any number of the PTC elements can be interposed between the terminal plates.

Figure 3:
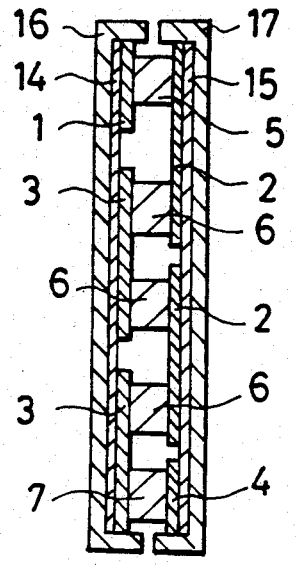
FIG. 3 is a sectional view of another embodiment of the present invention wherein the arrangement of the PTC elements with respect to the terminal plates is different from that of the embodiment of FIG. 1.

FIG. 3 illustrates another embodiment of the present invention wherein five PTC elements 5, 6, 6, 6 and 7 are sandwiched between six terminal plates, disposing three plates 1, 3 and 3 on one side of the PTC elements and disposing the other three plates 2, 2 and 4 on the other side of the PTC elements. In this arrangement, the terminal plate 1 disposed at an end of one of the sides of the PTC elements is connected to the terminal plate 4 disposed at the other end to the other side of the PTC elements in series through the PTC element 5, the terminal plate 2, the PTC element 6, the terminal plate 3, the PTC element 6, the terminal plate 2, the PTC element 6, the terminal plate 3 and the PTC element 7. In accordance with the arrangement mentioned above, fifteen different resistance values can be obtained from the combination number of any two of six terminals.

It is to be noted that the projecting terminal is not necessarily formed to every terminal plate but it may be formed only to necessary plates. Also, the shape of the terminal is not limited to that illustrated in the drawings.

Figure 4:
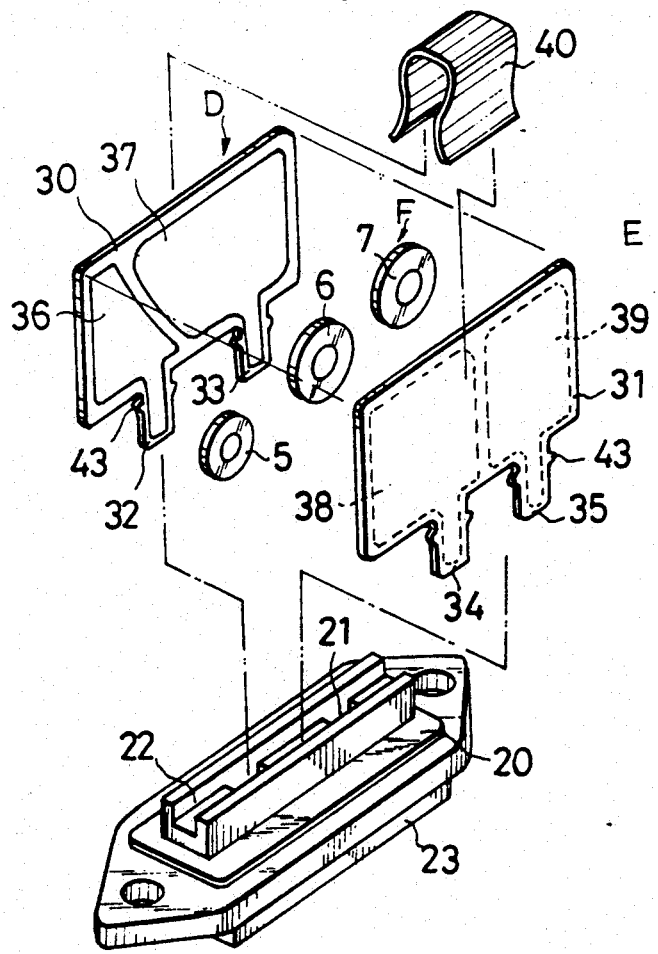
FIG. 4 is an exploded view of still another embodiment of the resistor device in accordance with the present invention.

FIG. 4 illustrates another embodiment of the present invention. Reference F designates a group of PTC elements 5, 6 and 7, each having a size corresponding to a required resistance value and current capacity as in the case of the embodiment of FIG. 1.

Numeral 30 designates an electric insulation plate made from alumina and having protruding terminal portions 32 and 33 formed at the lower edge thereof extending downward therefrom. On one of the side surfaces of the insulation plate, electrode members 36 and 37 are coated by printing conductive ink, for instance, extending continuously into the terminal protrusions 32 and 33, respectively. The electrode members 36 and 37 are electrically separated from each other. The insulation plate 30 and the electrodes 36 and 37 constitute a terminal plate designated by reference D as a whole. In this particular embodiment, the electrode member 36 occupies about one third of the plate 30 in the left side thereof while the other electrode member 37 occupies about two thirds of the plate 30 in the right side thereof.

Numeral 31 designates an electric insulation plate made from the same material as the plate 30 mentioned above and having also protruding portions 34 and 35 for terminal extending from the lower edge thereof. Also, electrode members 38 and 39 are similarly formed on the surface of the plate 31 facing to the electrodes of the plate 30. The electrodes 38 and 39 are electrically independent from each other and extend into the protrusions 34 and 35, respectively. The insulation plate 31 and the electrode members 38 and 39 constitute a terminal plate designated by reference E as a whole. The electrode member 38, in this particular embodiment, occupies about two thirds of the plate 31 in the left side thereof seen from the back side thereof while the electrode member 39 occupies about one third of the plate in the right side thereof.

Figure 5:
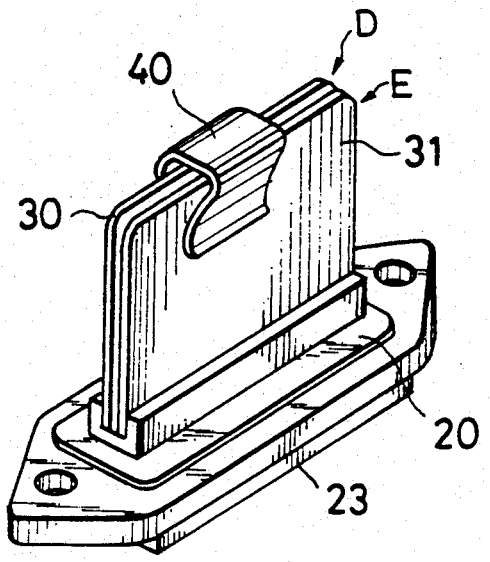
FIG. 5 is a perspective view of an assembled state of the resistor device of FIG. 4.

The terminal plates D and E are disposed in such a way that the electrode members thereof face to each other and that the PTC elements 5, 6 and 7 are interposed between the plates D and E in a state of being arranged side by side in a same plane. The PTC element 5 is disposed between the electrodes 36 and 38. The PTC element 6 is disposed between the electrodes 37 and 38. And the PTC element 7 is disposed between the electrodes 37 and 39. In this state, the terminal plates D and E are combined and secured together by an elastic clip 40 as illustrated in FIG. 5.

Figure 6:
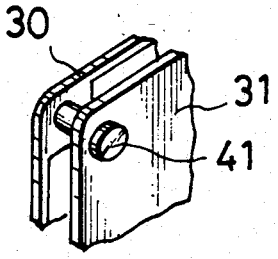
FIG. 6 is a partial perspective view of rivet means for combining and securing the terminal plates and the PTC elements.
Figure 7:
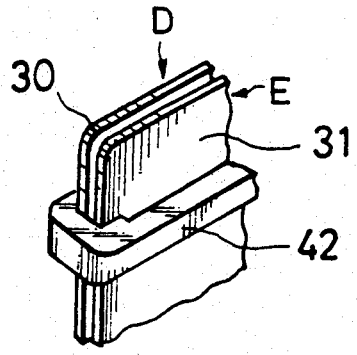
FIG. 7 is a partial perspective view of frame means as another example for combining and securing the terminal plates and the PTC elements.

It is to be noted that the two terminal plates D and E may be combined and secured together by a rivet 41 at each corner thereof, as illustrated in FIG. 6, instead o the clip 40 mentioned above. Or otherwise, a rectangular frame 42 may be used to combine and secure the two terminal plates D and E, by inserting the plates into the frame 42, as illustrated in FIG. 7.

In the above mentioned state where the three PTC elements 5, 6 and 7 are sandwiched and pressed by four electrode members 36 to 39, the combined structure is installed into the base holder 20 in such a way that the terminal protrusions 32 to 35 projecting from the lower edges of the plates D and E are inserted into through-holes 21 formed in the base holder 20 corresponding to the protrusions 32 to 35, respectively. The base holder is formed substantially in the same shape as that of the embodiment of FIG. 1.

It is to be noted that numeral 43 is a small projection for engagement formed on each lateral side edge of the terminal protrusion in order to engage and introduce into the inner wall of the through-hole 21 to prevent the protrusion from being slipped out from the through-hole 21.

As mentioned above, the PTC elements 5, 6 and 7 are disposed side by side in a same plane and sandwiched between a pair of terminal plates D and E which have electrode members 36, 37, 38 and 39 in the inner side thereof, respectively. In this state, the PTC elements are held and pressed from both outer side thereof by the plates D and E with the use of any appropriate means, such as clip means, for instance, as in the case of FIG. 5. The sandwich structure is installed into the base holder 20 by inserting the protruding terminal portions 32 to 35 into the through-holes 21 formed in the base holder 20 so that the sandwich structure is reliably assembled with the base holder by the function of the small projections formed on the terminal portion, as mentioned above.

It is to be noted that in the above mentioned embodiment of the present invention, as in the case of the preceding embodiments, the number of PTC elements and/or electrode members are not limited to that illustrated. Also, the electrode members may be formed by affixing sheet-like electrodes to the plate by an appropriate bonding means, instead of printing the electrodes with the use of conductive ink.

Figure 8:
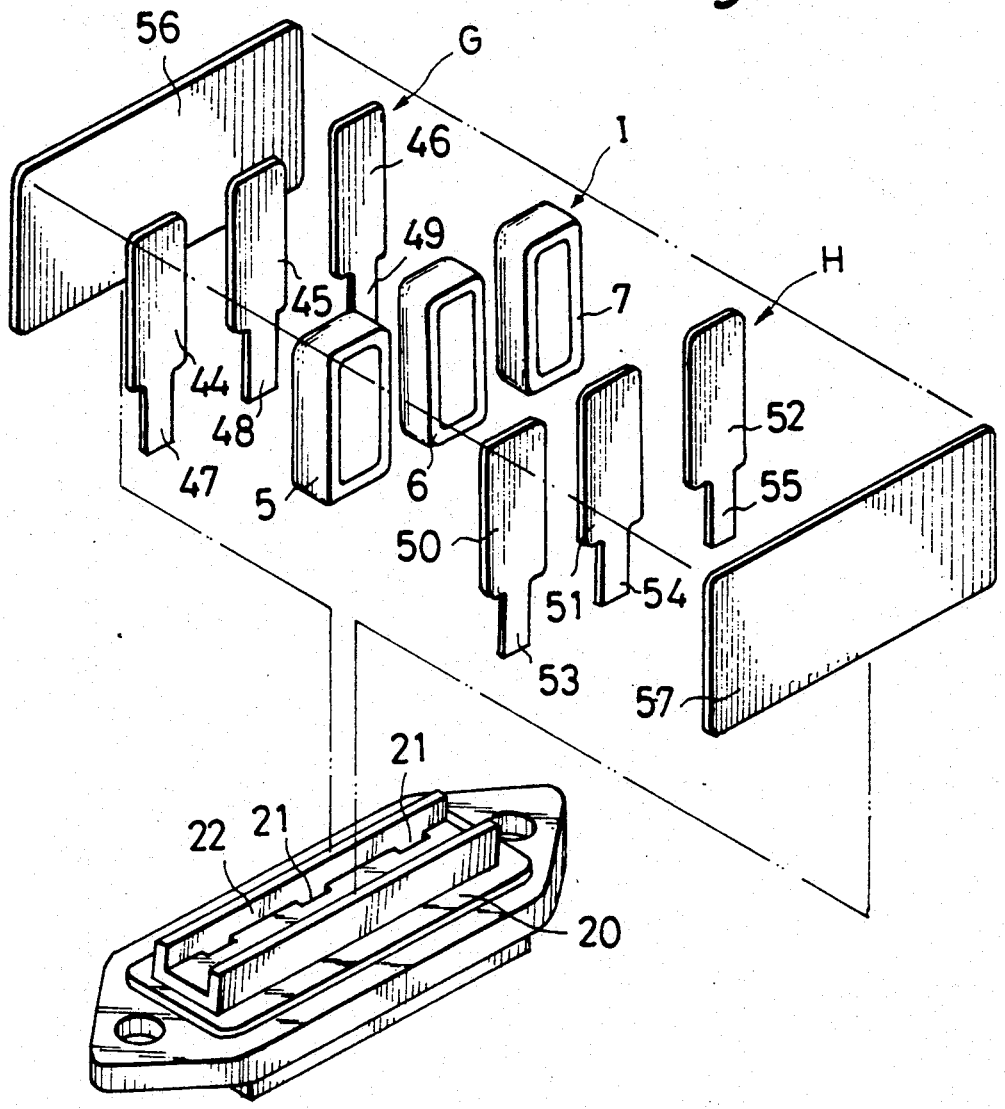
FIG. 8 is an exploded view of still another embodiment of the resistor device in accordance with the present invention.

FIG. 8 illustrates a still further embodiment of the resistor device in accordance with the present invention in an exploded view thereof. A PTC element group I is constituted from three PTC elements 5, 6 and 7, in this particular embodiment, each element having a size corresponding to a required resistance and current capacity, as in the case of embodiment of FIG. 1.

Numerals 44, 45 and 46 designate terminal plates constituting a terminal plate group G which is disposed facing to the front side of the PTC elements 5, 6 and 7. Each of the terminal plates has a terminal portion 47, 48, 49 protruding from the lower edge thereof. Numerals 50, 51 and 52 designate terminal plates similarly constituting a group H of terminal plates disposed facing to the rear side of the PTC elements 5, 6 and 7. The terminal plates 50 to 52 also have protruding terminal portions 53, 54 and 55, respectively, formed at the lower edges thereof.

In this embodiment, the device structure is essentially arranged in such a way that each of the plurality of PTC elements which are disposed side by side in a same plane is sandwiched by a pair of terminal plates arranged individually for each element. Electric insulation plates 56 and 57 are disposed in the outer sides of the terminal plates, respectively. The plates 56 and 57 are combined and secured together sandwiching the PTC elements and terminal plates therebetween by an appropriate clamping means such as clip means 40 of FIG. 5, rivet means 41 of FIG. 6 or rectangular frame means 42 of FIG. 7. And in the state where the group I of PTC elements is sandwiched and pressed by the pair of terminal plate groups G and H, the terminal protrusions 47 to 49 and 53 to 55 formed at the lower edges of the terminal plates are inserted into through-holes 21 formed in the base holder 20 corresponding to the protrusions. The sandwich structure is held and secured to the base holder by an appropriate means to form an assembly of the resistor device.

Figure 9:
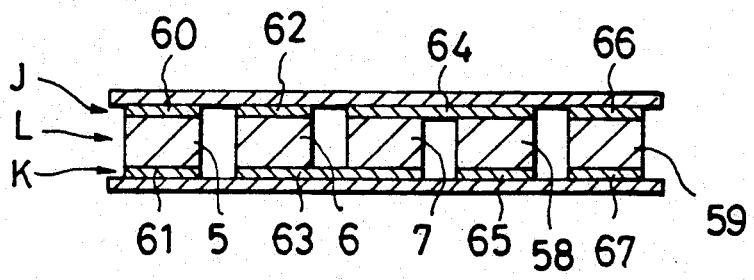
FIG. 9 is a sectional view of a further embodiment of the present invention wherein the arrangement of the PTC elements with respect to the terminal plates is different from those of the other embodiments.

FIG. 9 illustrates a still further embodiment of the resistor device in accordance with the present invention along a cross section thereof. A PTC element group L is constituted from five PTC elements 5, 6, 7, 58 and 59, disposed side by side in a same plane, each of which elements has a size corresponding to a required resistance and current capacity, as in the case of the embodiment of FIG. 1. In this embodiment of FIG. 9, the arrangement of terminal plates is featured in that the plates press and sandwich the PTC elements from both sides thereof in such a way that the PTC element 5 is held by terminal plates 60 and 61 which are independent from the other terminal plates, that the PTC element 6 is held by an independent terminal plate 62 disposed in one side thereof and a terminal plate 63 disposed in the opposite side thereof covering also the adjacent PTC element 7, that the element 7 is held by the plate 63 and a terminal plate 64 disposed in the opposite side of the plate 63 which plate 64 spans between the elements 7 and 58, that the PTC element 58 is held by the terminal plate 64 and an independent terminal plate 65, and that the PTC element 59 is held by independent terminal plates 66 and 67 from both sides thereof.

In above with the embodiment of FIG. 9 mentioned above, from the combination of five PTC elements and eight terminal plates, it becomes possible to obtain various different resistance values in a manner different from those of the preceding embodiments mentioned before.

It is to be noted that in the illustrated embodiments mentioned above, the PTC elements have a same thickness for every embodiment. However, the thickness and size of the PTC elements are not necessarily the same in the same group of the elements. If a PTC element of different thickness is included in a group of PTC elements, the thickness of the insulation plate disposed in the outside of the terminal plates is adjusted to compensate for the unevenness of thickness so as to obtain a flat outer plane of the resistor device.

It is also to be noted that the shape of the PTC element is not limited to the circular shape or rectangular shape as illustrated in the drawings.

Many widely different embodiments of the present invention may be constructed without departing from the spirit and scope of the present invention. It should be understood that the present invention is not limited to the specific embodiments described in the specification, except as defined in the appended claims.

What is claimed is:

1. A resistor device for a blower motor comprising:

a plurality of PTC element plates arranged so as to form a substantial same plane, and each having electrodes formed respectively on both faces thereof;

a plurality of terminal plates arranged respectively outside of said both faces of each of said PTC element plates;

two insulation films arranged respectively outside of said terminal plates, and each having a heat conductivity; and two heat radiative plates sandwiching said PTC element plates through said terminal plates and said insulating films.

2. A resistor device for a blower motor according to claim 1, wherein said plurality of terminal plates include a plate comprising an electrode disposed spanning between a plurality of PTC element plates.

3. A resistor device for a blower motor according to claim 1 or 2, wherein said plurality of PTC element plates are connected sequentially in series through said terminal plates disposed in both faces of said PTC element plates.

4. A resistor device for a blower motor according to claim 1, wherein each of said terminal plates has at least one electrode terminal portion projecting therefrom.

5. A resistor device for a blower motor according to claim 4, wherein said PTC element plates sandwiched by said terminal plates, said insulation films and said heat radiative plates are attached to a base holder in such a way that said projecting terminal portions of said terminal plates are inserted into through-holes formed in said base holder corresponding to said terminal portions.

6. A resistor device for a blower motor according to claim 5, wherein said PTC element plates, said terminal plates, said insulation films and said heat radiative plates are held and clamped by a flexible clip means.

7. A resistor device for a blower motor according to claim 5, wherein said PTC element plates, said terminal plates, said insulating films and said heat radiative plates are held and clamped by a rivet means.

8. A resistor device for a blower motor according to claim 5, wherein said PTC element plates, said terminal plates, said insulating films and said heat radiative plates are held and clamped by a rectangular frame means.

9. A resistor device for a blower motor comprising:

a plurality of PTC element plates arranged so as to form a substantial same plane, and each having electrodes formed respectively on both faces thereof;

two terminal plate means having a plurality of electrode members for sandwiching said PTC element plates from said both faces thereof, said electrode members being separated electrically from each other.

10. A resistor device for a blower motor according to claim 9, wherein at least one of said electrode members spans between a plurality of PTC element plates.

11. A resistor device for a blower motor according to claim 9 or 18, wherein said plurality of PTC element plates are connected sequentially in series through said terminal plate means disposed in both faces of said PTC element plates.

12. A resistor device for a blower motor according to claim 9, wherein each of said terminal plate means has at least one electrode terminal portion projecting therefrom.

13. A resistor device for a blower motor according to claim 12, wherein said PTC element plates sandwiched by said terminal plate means are attached to a base holder in such a way that said projecting terminal portions of said terminal plate means are inserted into through-holes formed in said base holder corresponding to said terminal portions.

14. A resistor device for a blower motor according to claim 19, wherein said PTC element plates and said terminal plate means are held and clamped by a flexible clip means.

15. A resistor device for a blower motor according to claim 13, wherein said PTC element plates and said terminal plate means are held and clamped by a rivet means.

16. A resistor device for a blower motor according to claim 13, wherein said PTC element plates and said terminal plate means are held and clamped by a rectangular frame means.

* * * * *

UNITED STATES PATENT AND TRADEMARK OFFICE

CERTIFICATE OF CORRECTION

PATENT NO. : 5,218,336

DATED : June 8, 1993

INVENTOR(S) : I. Murakami

It is certified that error appears in the above—identified patent and that said Letters Patent is hereby corrected as shown below:

Title page: Section [75] Inventor, Change "Toro" to --Yoro-Gun--.

Column 9, claim 11, line 2, change "claim 9 or 18" to --claim 9 or 10--.

Column 10, claim 14, line 2, change "claim 19" to --claim 13--.

Signed and Sealed this

Eighth Day of March, 1994

Bruce Lehman

*Attest:*

BRUCE LEHMAN

*Attesting Officer*

*Commissioner of Patents and Trademarks*